US006795039B2

(12) United States Patent
Takimoto et al.

(10) Patent No.: US 6,795,039 B2
(45) Date of Patent: Sep. 21, 2004

(54) ANTENNA SYSTEM AND METHOD FOR MANUFACTURING THE SAME

(75) Inventors: Atsushi Takimoto, Tokyo (JP); Mikio Yamashita, Tokyo (JP); Masashi Ura, Tokyo (JP); Noboru Kawaguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/124,455

(22) Filed: Apr. 18, 2002

(65) Prior Publication Data

US 2003/0076275 A1 Apr. 24, 2003

(30) Foreign Application Priority Data

Oct. 22, 2001 (JP) ..... 2001-323830

(51) Int. Cl.[7] ..... H01Q 15/16
(52) U.S. Cl. ..... 343/909; 343/914
(58) Field of Search ..... 343/914, 909, 343/916, 753, 755; 359/627, 619, 626

(56) References Cited

U.S. PATENT DOCUMENTS 4,458,251 A * 7/1984 Bondon ..... 343/914
4,915,800 A * 4/1990 Nakanishi et al. ..... 204/35.1
6,507,441 B1 * 1/2003 Eisenberg et al. ..... 359/627

FOREIGN PATENT DOCUMENTS

JP 62-131611 6/1987

* cited by examiner

*Primary Examiner*—James Vannucci
(74) *Attorney, Agent, or Firm*—Oblon, Spivak, McClelland, Maier & Neustadt, P.C.

(57) ABSTRACT

An antenna system is provided with an antenna panel 1 which has fine bumps and dips 4 formed on a mirror surface side, which is one of surfaces opposing to each other, by etching, wherein the fine bumps and dips scatter sunlight entering the mirror surface side of the antenna panel 1 to suppress the collection of the sunlight and regularly reflect radio waves having longer wavelength than the sunlight entering the mirror surface side of the antenna panel.

11 Claims, 7 Drawing Sheets

REFLECTING CHARACTERISTICS
BY ACID ETCHING

ANTENNA SYSTEM AND METHOD FOR MANUFACTURING THE SAME

BACKGROUND OF THE INVENTION

1. Field of the Invention

The present invention relates to an antenna system in which millimeter waves or sub-millimeter waves having a frequency exceeding 100 GHz are used to reduce the influence of sunlight collected in the vicinity of a focal point of an antenna, and relates to a method for manufacturing such an antenna system.

2. Description of the Related Art

FIG. 7 is an illustration showing the structure of a conventional antenna system. In FIG. 7, a reference numeral 1 denotes an antenna panel; a reference numeral 2 denotes a coating film painted in white or with a semi-gloss on the front surface of the antenna panel 1; and a reference numeral 3 denotes an assistant reflecting mirror disposed on the focal portion of the antenna panel 1. Incident radio waves of millimeter waves or sub-millimeter waves are focused on the assistant reflecting mirror 3 by the antenna panel 1. On the other hand, since sunlight entering the antenna panel 1 is as short as 1 $\mu$m or less in terms of its wavelength, as compared with the millimeter waves or the sub-millimeter waves, it is irregularly reflected by the front surface of the coating film 2 painted in white or with a semi-gloss, and is not focused on the assistant reflecting mirror 3.

However, if the frequency used in this kind of antenna system is higher, there is a problem that the radio waves of millimeter waves or sub-millimeter waves passing through inside the coating film 2 are attenuated, to thereby lower the antenna sensitivity or to degrade the observed signals to noise ratio.

In order to solve such a problem, in the related art, there is an antenna system disclosed, for example, in Japanese Patent Application Laid-Open No. 62-131611. FIG. 8 is a schematic sectional view of a conventional antenna system disclosed in the same gazette. In FIG. 8, a reference numeral 1 denotes an antenna panel and a reference numeral 4 denotes fine bumps and dips formed on one surface of the antenna panel 1. The object of this related art is to manufacture an antenna panel which has a diameter of about 50 cm and which can be used without painting.

This antenna panel 1 is manufactured as follows: very small grooves are formed on the front surface of a flat plate previously, though they may be formed later, and then the flat plate is bent and deformed to form the antenna panel 1. In this manner, the elimination of the coating film 2 makes it possible to use the antenna panel 1 even in a high frequency. Further, the fine bumps and dips formed on the front surface of the antenna panel 1 restrain the light reflected by the antenna panel 1 from being collected on a light collecting portion, which results in preventing an assistant reflecting mirror disposed at the light collecting portion from rising in temperature.

The aforementioned gazette discloses that the fine bumps and dips on the front surface of the antenna panel 1 are formed by making scratches in the shape of straight lines or curved lines on the front surface of the antenna panel 1, or by blasting or etching the front surface. Here, the scratches in the shape of straight lines or curved lines are mechanically made by an abrasive paper, an abrasive cloth, a grinder or the like.

FIG. 9 is a graph to show the sunlight reflecting characteristics of a polished surface of a flat plate sample which is made of aluminum (Al) and mechanically polished, and FIG. 10 is an illustration to show a method of measuring the reflecting characteristics. As shown in FIG. 10, the flat plate sample is disposed just opposite to the sun and the reflecting characteristics is measured with an illuminator which is provided with a lightproof cylinder, so that the sunlight is detected only from the front, by changing the angle of the illuminator with respect to the flat plate sample is changed. The surface roughness of the #40 polished product is 4.4 $\mu$m RMS (Root Mean Square) and as shown in FIG. 9, the illuminance is very high near the angle of 0 degree and the sunlight is not scattered greatly. Here, the character #40 designates the grain size of abrasive grains and the abrasive grain size becomes smaller as the number is larger.

Theoretically, the extent to which the reflecting scattering characteristics is required is determined as follows. FIG. 11 is a characteristic graph to show the relationship between the ratio of scattered light collected on an assistant reflecting mirror (450 mm) which is in a focal portion and the scattering angle (half width having a half of a peak value), in the case of a large-size millimeter-wave parabolic antenna system which is of the order of 10 m. In this case, energy entering a parabolic antenna is $1\times10^5$ W when the parabolic antenna is just opposite to the sun. When this energy is multiplied by the collecting ratio of the sunlight and the absorptivity of the assistant reflecting mirror, the temperature rises by about 100° C. if the light collecting ratio is 0.015. Such temperature rising is considered to be a limit in use, though not sufficient, if time for the parabolic antenna to be just opposite to the sun is not so long. As shown in FIG. 11, the scattering angle (half width) is 55 degrees when the light collecting ratio is 0.015 and thus the scattering angle needs to be larger than the above value of 55 degrees.

In the sample shown in FIG. 9 which is mechanically polished, the scattering angle, that is, the half width having a half of the peak value is 10 degrees and the light collecting ratio at this time is 0.3, so according to a similar calculation, the temperature rises up to 2,000° C. Since this temperature exceeds the melting point of aluminum, means of polishing is not applicable to a surface processing method of the parabolic antenna which is of the order of 10 m.

On the other hand, in the sunlight reflecting characteristics of a flat plate sample which is made of aluminum and whose surface is subjected to blasting, the surface subjected to blasting has a surface roughness of about 0.4 $\mu$m RMS and shows a scattering angle larger than 55 degrees. Further, in the sunlight reflecting characteristics of a flat plate sample which is made of aluminum and whose surface is etched, the etched surface has a surface roughness of about 1.2 $\mu$m RMS and shows a large scattering angle and good scattering characteristics. However, the surface subjected to an electrolytic polishing or a chemical polishing becomes very smooth in surface irregularity and is not applicable.

As is evident from the above description, among methods described in the above gazette, a surface processing for preventing the sunlight from being collected on the assistant reflecting mirror when it is applied to a parabolic antenna of the order of 10 m is only blasting and etching.

In the antenna panel 1 of a parabolic antenna for millimeter waves and sub-millimeter waves, in the case where the diameter is about 10 m, a mirror surface accuracy is required to be a very high accuracy of 10 $\mu$m or less RMS. In many cases, in the antenna panel 1 of the parabolic antenna using a usual wavelength a little longer than the millimeter waves and the sub-millimeter waves, the mirror surface accuracy is required to be larger than 200 $\mu$m RMS.

In manufacturing the antenna panel 1 like this, a thin plate is deformed and fixed to ribs (reinforcing members), which are also deformed in advance, by means of welding, adhesion, riveting or the like. However, it is difficult to achieve a mirror surface accuracy higher than this level by this manufacturing method. Therefore, the mirror surface side needs to be formed by machining, which can produce a high surface accuracy.

Further, since the antenna panel is too heavy if it is a large block, the back surface thereof needs to be machined so as to thin the panel. If the panel is only machined to reduce its thickness, it has no sufficient rigidity and thus needs to have a structure in which reinforcing ribs are fixed to the back surface thereof. In such a manufacturing method, many panels about 1 m square are made and combined with each other to manufacture the antenna panel 1 of 10 m in diameter.

However, there is the following problem in the case where the surface processing of blasting or etching to satisfy the reflecting and scattering properties is applied to the panel described above.

First, the case where the panel is subjected to blasting will be described. Although the blasting method itself is not a problem, the surface subjected to blasting is deformed plastically by the blasting and is inevitably brought into an elongated state, thereby being deformed convexly. If the mirror surface (front surface) side and the back surface side are subjected to the same blasting, the deformation does not occur, but if the shape of the mirror surface side is very different from that of the back surface side, it is difficult to equalize the blasting conditions for both the surfaces. For example, if the back surface side is provided with the reinforcing ribs, the reinforcing ribs prevent the abrasive grains from hitting the back surface appropriately. If the wavelength is long, the amount of deformation is negligible but if the wavelength becomes as small as the sub-millimeter waves, the amount of deformation exceeds the required accuracy.

Next, the case where the panel is subjected to etching will be described. Since the etching removes the surface of the panel by several $\mu$m, it can remove residual stresses in the layer where the quality is altered by machining. Therefore, if the residual stresses to be removed by the etching are different between the front surface side and the back surface side, stresses in both sides get out of balance, which causes the deformation of the panel.

FIG. 12 is a graph to show the deformation of a sample caused by etching in the case where the residual stresses in the front and back surface sides of the sample are different from each other, and shows the amount of deformation of the sample, which is made by shaving a plate of 10 mm thick and 250 mm square in the shape of # to a thickness of 2 mm, when the sample is etched by a caustic soda (NaOH, sodium hydrate). On the mirror surface side, the residual stress is small because machining conditions such as the depth of cut and a feed rate are not so severe, whereas on the back surface side, because considerably severe machining conditions are used to increase productivity, the residual stress is made large and thus the sample is greatly deformed by etching. Even in the case of using etching, this deformation is a big problem. Further, the surface roughness becomes large, depending on the etching conditions, which might scatter also radio waves to be observed.

In this respect, the deformation of the panel, which becomes a problem when the panel is subjected to blasting and etching, can be avoided to a certain extent by increasing the rigidity of the panel. For example, if the thickness of the plate forming the mirror surface is doubled, strength is increased by 8 times to greatly decrease the amount of deformation. However, increasing the rigidity of the panel increases also the weight thereof and thus there is a limit in this measure.

FIG. 13 is a characteristic graph to show the relationship between the surface roughness and the service frequency of the antenna panel. As shown in FIG. 13, in order to make the service frequency available up to as high a frequency as 2 THz, it is necessary to make the magnitude of the fine bumps and dips showing the surface roughness not larger than 5 $\mu$m RMS. The service frequency is determined by the following equation $$\text{Service frequency}=\text{speed of light}/(\text{surface roughness}\times 30)$$

Since the antenna system in the related art is constituted in the above manner, in the case where the panel constituting the antenna panel is subjected to blasting or etching so that the fine bumps and dips are formed on the panel, there is a problem that the amount of deformation of the front surface of the panel becomes large and exceeds a required mirror accuracy.

SUMMARY OF THE INVENTION

The present invention has been made to solve the problems described above. It is the object of the present invention to provide an antenna system provided with an antenna panel which can be used for radio waves in a high frequency range of from millimeter waves to sub-millimeter waves and has an excellent reflecting performance to suppress the collection of the sunlight and a high mirror surface accuracy, and a method for manufacturing the same.

An antenna system according to the present invention is provided with an antenna panel having fine bumps and dips formed on a mirror surface side, which is one of surfaces opposing to each other, by etching, wherein the fine bumps and dips scatter sunlight entering the mirror surface side of the antenna panel, yet regularly reflect radio waves having longer wavelength than the sunlight entering the mirror surface side of the antenna panel.

In the antenna system according to the present invention, the antenna panel has the fine bumps and dips formed on the mirror surface side by etching the mirror surface side by use of an acid solution.

In the antenna system according to the present invention, the surface roughness of the fine bumps and dips is in a range of from 0.5 $\mu$m RMS to 5 $\mu$m RMS.

In the antenna system according to the present invention, the antenna panel has fine bumps and dips having a chemical surface film formed thereon on the surface thereof.

In the antenna system according to the present invention, the antenna panel has fine bumps and dips having a chemical surface film formed thereon by alodine processing on the surface thereof.

A method for manufacturing an antenna system according to the present invention includes the steps of: finishing front and back surface sides of opposing surfaces of each of the constituent parts; masking the back surface side of each of the finished constituent parts and etching the front surface side thereof to form the fine bumps and dips; and combining the plurality of constituent parts subjected to the etching step in such a manner that their front surface sides form the mirror surface side of the antenna panel to assemble the antenna panel of a desired shape.

In the method for manufacturing an antenna system according to the present invention, the etching step is performed by etching the front surface side of each of the finished constituent parts by use of an acid solution.

In the method for manufacturing an antenna system according to the present invention, the etching step is performed by etching the front surface side of each of the finished constituent parts by use of an alkali solution and thereafter by an acid solution.

In the method for manufacturing an antenna system according to the present invention, the etching step is performed such that the surface roughness of the fine bumps and dips is made in a range of from 0.5 $\mu$m RMS to 5 $\mu$m RMS.

The method for manufacturing an antenna system according to the present invention further includes the step of applying a surface treatment for forming a chemical surface film to the front surface side of each of the constituent parts subjected to the etching step.

In the method for manufacturing an antenna system according to the present invention, the surface treatment step forms the chemical surface film by the alodine processing.

In the method for manufacturing an antenna system according to the present invention, the finishing step before the etching step forms the fine bumps and dips on the front surface side of each of the constituent parts by cutter marks produced when the front surface side of each of the constituent parts is subjected to machining.

DETAILED DESCRIPTION OF THE PREFERRED EMBODIMENTS

Preferred embodiments of the present invention will be described in the following.

(First Embodiment)

Figure 1:
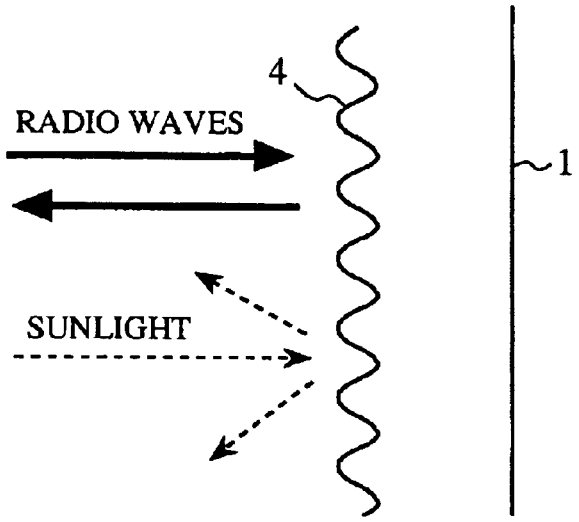
FIG. 1 is an enlarged view of a structure of an antenna panel in an antenna system according to a first embodiment of the present invention.

FIG. 1 is an enlarged view of a structure of an antenna panel in an antenna system according to the first embodiment of the present invention. In FIG. 1, a reference numeral 1 denotes an antenna panel having fine bumps and dips 4 formed on its front surface. Since the fine bumps and dips 4 are formed on the front surface of the antenna panel 1 in this manner, radio waves which are longer in wave length than the sunlight are reflected regularly, whereas the sunlight having shorter wave lengths is scattered by the front surface of the antenna panel 1.

Next, a method for manufacturing the antenna panel 1 will now be described. The antenna panel 1 is constituted by combining a plurality of panels (constituent parts) and each of respective panels is made of an aluminum alloy (for example, A5052) and set to be about 1 m square and about 40 mm thick. The back surface side of each of the panels made of an aluminum alloy is machined by a machining center so that appropriate reinforcing portions are left. The front surface of each of the aluminum alloy panels is machined so as to have a predetermined radius of curvature in accordance with its position in the antenna panel 1 to form a part of the antenna panel 1 of the order of 10 m. The thickness of the panel constituting a panel mirror surface ranges from 2 mm to 3 mm. At this time, the mirror surface accuracy of the panel is at least not larger than 10 $\mu$m RMS and a surface roughness is not larger than 1 $\mu$m RMS. The aluminum alloy panel at this time reflects the sunlight like a mirror.

This panel is degreased and washed and then a temporary rust preventive agent of separation type is sprayed as a mask on the back surface side so as to prevent the back surface side from being etched. At this time, it is necessary to take care not to attach this rust preventive agent to the mirror surface side. This temporary rust preventive agent of separation type has styrene butadiene as a main raw material and when it solidifies, it shows the quality of rubber and can be separated from the surface of metal with considerable ease.

This panel is dipped in an acid solution of about 10% ammonium monohydrogen difluoride at a liquid temperature of 30° C. for 3 minutes, thereby being etched. At this time, the acid solution in an etching tank is circulated so as to prevent an unevenness in etching. After three minutes, the panel is taken out of the etching tank and immediately washed with water. Performing such etching process produces a mat surface of fine bumps and dips 4 on the front surface of the panel.

Thereafter, the temporary rust preventive agent of separation type is removed and then a desmutting process for removing smut, which is an impurity of aluminum, is performed and then an alodine processing (surface treatment) for forming a chemical surface film is performed to improve weatheproof characteristics (wear resistance, corrosion resistance). The temporary rust preventive agent of separation type may be removed after the desmutting process is performed.

Figure 2:
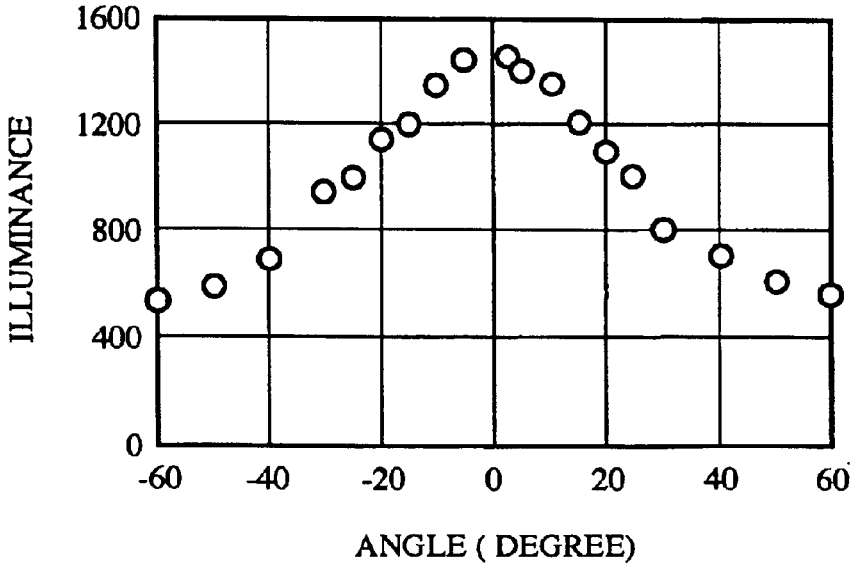
FIG. 2 is a graph to show a sunlight reflecting characteristics on the front surface of the antenna panel in the case where the antenna panel is etched by an acid solution in the antenna system according to the first embodiment of the present invention.

FIG. 2 is a graph to show the sunlight reflecting characteristics of the front surface on the panel in the case where the front surface of the panel is etched by the acid solution. The surface roughness after etching is 1.2 μm RMS and the scattering angle of the sunlight (half width) is about 55 degrees. Since the mirror surface side is finished very smoothly by machining, there is little residual stress to be released and thus distortion is not produced by etching.

By arranging many panels manufactured in the same way at predetermined positions, the antenna panel 1 having a panel mirror accuracy of about 10 μm or less and a diameter of 10 m is assembled.

In this respect, an etching liquid used for etching is not necessarily the ammonium monohydrogen difluoride described above but may be other etching liquid. Further, the etching conditions are not limited to the above ones but there is a case where the same mat surface can be produced even under the different conditions by an appropriate combination of concentration, temperature, and time.

Figure 3:
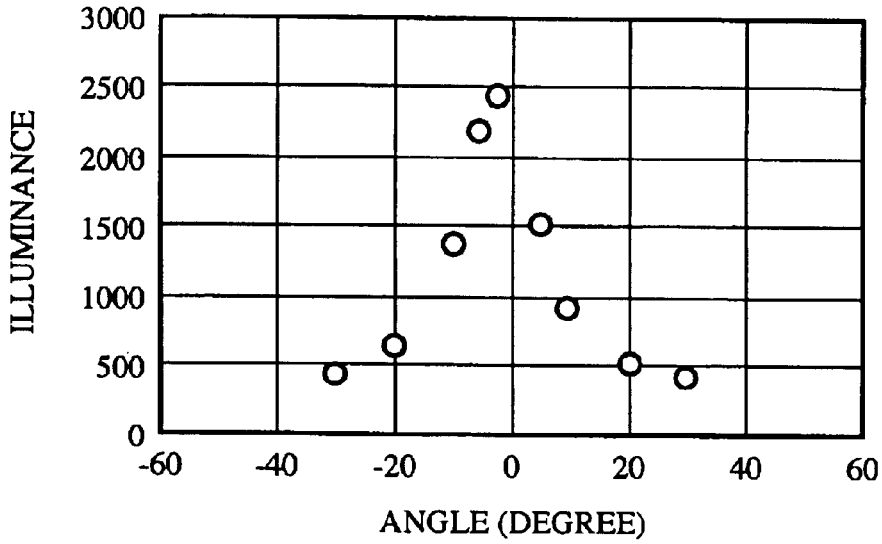
FIG. 3 is a graph to show the sunlight reflecting characteristics of the antenna panel in the case where the antenna panel is etched by a caustic soda.

Further, the state of the mat surface is varied, depending on the etching liquid and etching conditions. FIG. 3 is a graph to show the sunlight reflecting characteristics on the surface of the panel in the case where the surface of the panel is etched by a caustic soda (NaOH). As shown in FIG. 3, the scattering angle is decreased as compared with the reflecting characteristics, shown in FIG. 2, in the case where the surface of the panel is etched by the acid solution.

Figure 4:
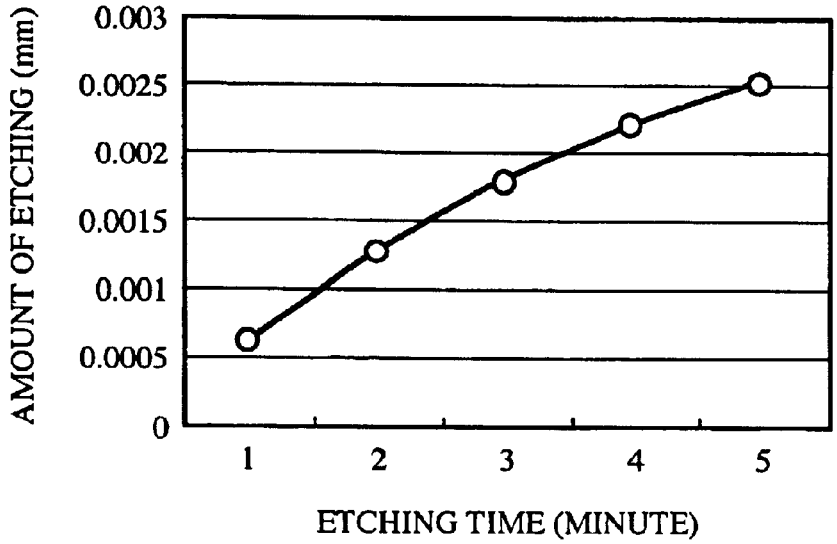
FIG. 4 is a characteristic graph to show the amount of etching with respect to an etching time in etching when the antenna system according to the first embodiment of the present invention is manufactured.
Figure 5:
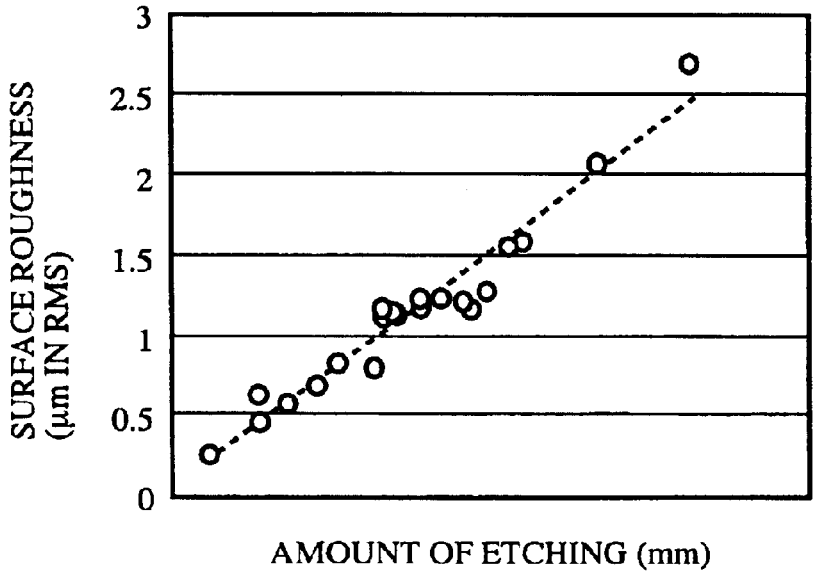
FIG. 5 is a characteristic graph to show a surface roughness with respect to the amount of etching in etching when the antenna system according to the first embodiment of the present invention is manufactured.

FIG. 4 is a characteristic graph to show the amount of etching with respect to an etching time in etching. As shown in FIG. 4, in etching, the amount of etching is proportional to the etching time. Further, FIG. 5 is a characteristic graph to show a surface roughness with respect to the amount of etching in etching. As shown in FIG. 5, the surface roughness is nearly proportional to the amount of etching, so that it is very important to control the etching time. The etching time to be controlled is not the time during which the panel is actually dipped in the etching liquid but the total time including time elapsing from the time when the panel is taken out of the etching liquid to the time when the panel is washed with water.

Figure 6:
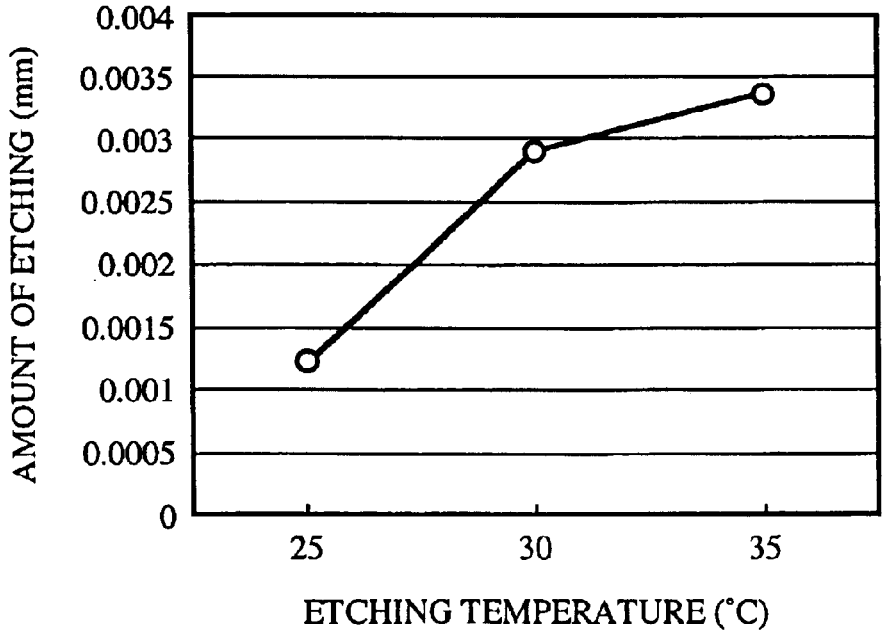
FIG. 6 is a characteristic graph to show the amount of etching with respect to an etching temperature in etching when the antenna system according to the first embodiment of the present invention is manufactured.
Figure 7:
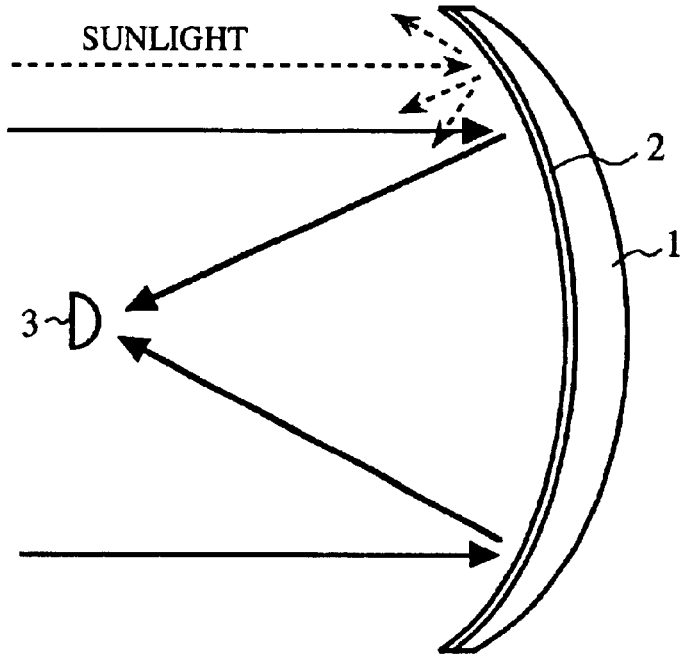
FIG.7 (PRIOR ART)
FIG. 7 is an illustration showing the structure of a conventional antenna system.
Figure 8:
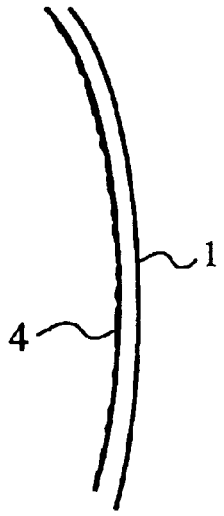
FIG.8 (PRIOR ART)
FIG. 8 is a schematic cross-sectional view of a conventional antenna system.
Figure 9:
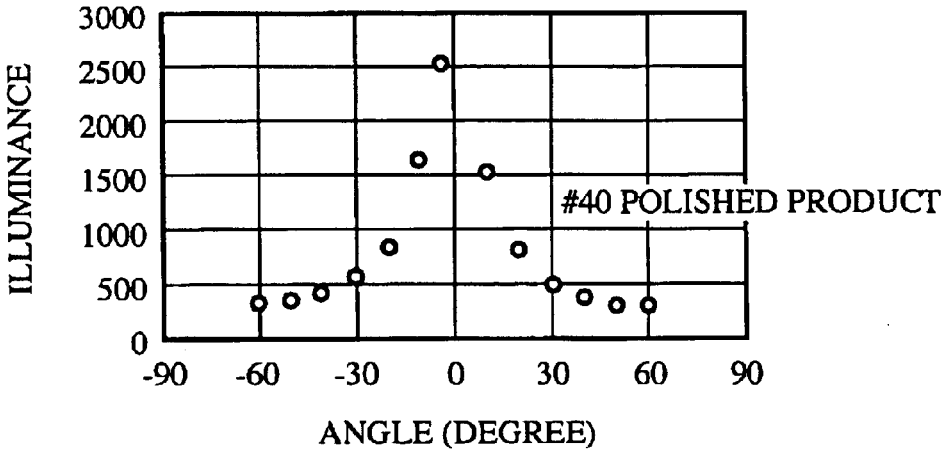
FIG. 9 is a graph to show a sunlight reflecting characteristics on the polished surface of a flat-plate sample whose surface is mechanically polished.
Figure 10:
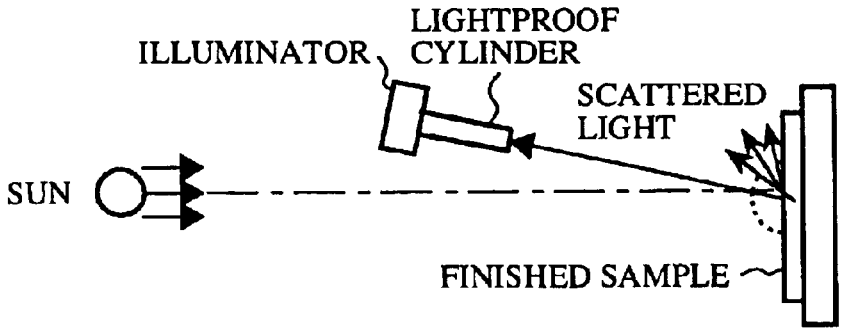
FIG. 10 is an illustration showing a method of measuring a sunlight reflecting characteristics.
Figure 11:
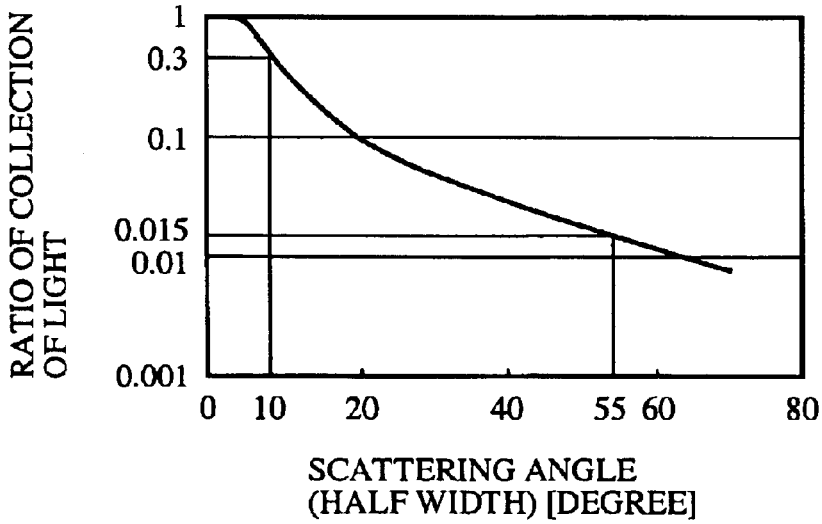
FIG. 11 is a characteristic graph to show the relationship between the ratio of scattered light collected on an assistant reflecting mirror and a scattering angle in an large-size parabolic antenna of the order of 10 m for millimeter waves.
Figure 12:
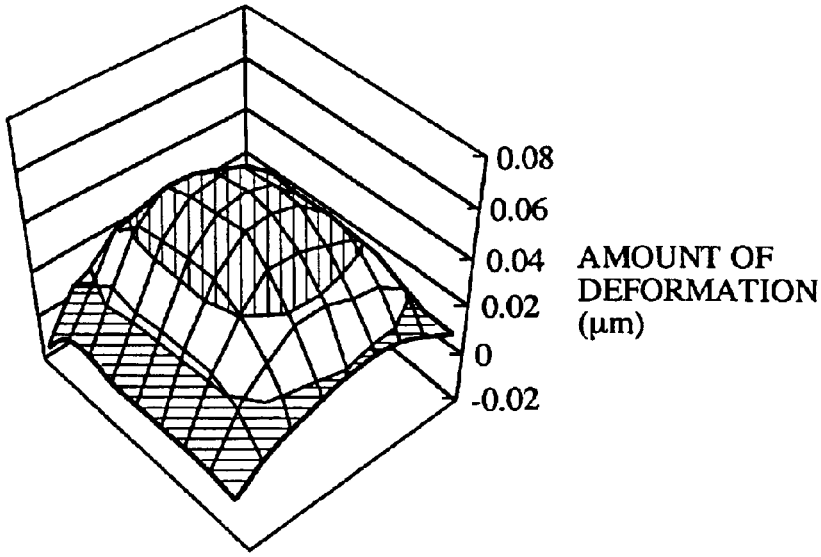
FIG. 12 is a graph to show the state of deformation caused by etching in the case where the residual stresses are different between the front and back surfaces of a sample subjected to machining.

FIG. 6 is a characteristic graph to show the amount of etching with respect to an etching temperature in etching. As shown in FIG. 6, the amount of etching is greatly decreased below 30° C. in this etching liquid and it is necessary to take care also on a temperature control. If the temperature is higher than 30° C., an etching speed increases, though gradually, and thus it is difficult to control the shape of the front surface. Further. in the case where etching is performed at a temperature higher than 40° C., there is a fear that the panel might be deformed by thermal stress when the panel is dipped in the etching liquid. Therefore, it is appropriate to set the etching temperature at a range from about 30° C. to 40° C. Needless to say, a recommendable etching temperature is varied, depending on the other conditions and is not limited particularly to the range described above.

Figure 13:
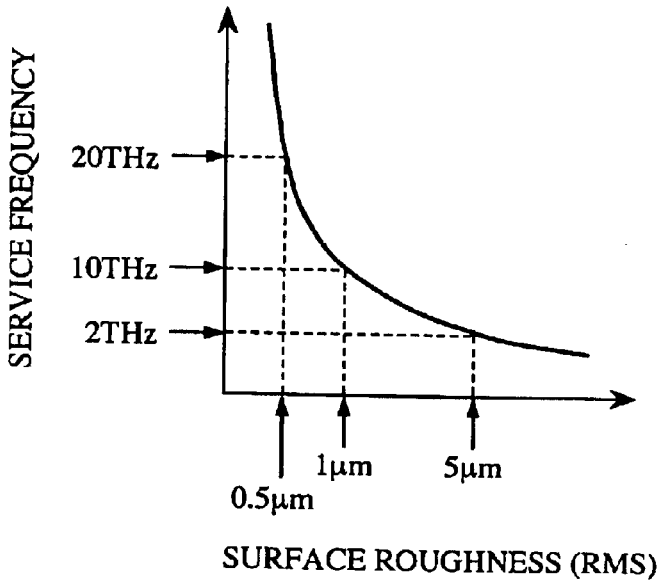
FIG. 13 is a characteristic graph to show the relationship between the surface roughness and the service frequency of an antenna panel.

Since the state of mat surface of the fine bumps and dips 4 is varied, depending on the etching conditions, as described above, it is necessary to select appropriate etching conditions in accordance with the desired state of surface. Since the service frequency is considered to be up to 2 THz, as shown in FIG. 13, it is necessary to make the surface roughness not larger than 5 μm RMS. Further, in order to scatter the sunlight, it is necessary to make the surface roughness not smaller than 0.5 μm RMS. That is, it is necessary to select the etching conditions so that the surface roughness ranges from 0.5 μm RMS to 5 μm RMS.

Further, in the case of the surface processing by etching, the alodine process for improving a weatherproof characteristics includes the steps of degreasing, etching oxide film, desmutting, and alodine processing, and among of these steps, only an etching liquid used for the step of etching the oxide film is replaced for the etching liquid of this time, so this surface processing by etching can be performed without making a major change to a manufacturing line or a manufacturing process.

Still further, the temporary rust preventive agent of separation type used as the mask is not particularly limited to this kind of agent, but any agent may be used on condition that it prevents the back surface side of the panel from being etched, for example, a film or a vinyl bag for curing, any means which is not impregnated with the etching liquid may be used. Further, it is also considered that etching is performed by showering and in this case, the etching liquid is comparatively hard to go around the back surface side, so the mask is not necessarily required.

Next, the operation of the antenna system will now be described.

If the radio waves entering the mirror surface side of the antenna panel 1 made of aluminum is in a range of frequency shown in FIG. 13, they are regularly reflected without being scattered while keeping an incident angle. On the other hand, the sunlight whose wavelength is shorter than that of the radio waves entering the mirror surface side of the antenna panel 1 and is irregularly reflected by the fine bumps and dips 4 on the mirror surface side of the antenna panel 1 and is not collected on the focal portion, so that the assistant reflecting mirror and a stay for supporting the assistant reflecting mirror are not affected by the reflected sunlight.

Further, since an alodine coating film is formed on the mirror surface side of the antenna panel 1 by the alodine processing, it is possible to constitute the antenna panel 1 rich in the weatherproof characteristics.

As described above, according to this first embodiment, by etching only the mirror surface side of the panel constituting the antenna panel 1 to form the fine bumps and dips 4 on the mirror surface side, it is possible to produce an effect of constituting the antenna panel 1 that can be used in the high frequency range of radio waves from the millimeter waves to the sub-millimeter waves and that has an excellent reflecting characteristics and a high mirror surface accuracy capable of suppressing the collection of the sunlight.

Further, according to the first embodiment, because the alodine coating film is formed on the mirror surface side of the antenna panel 1 by the alodine processing, it is possible to produce an effect of constituting the antenna panel 1 that is rich in the weatherproof characteristics.

(Second Embodiment)

While etching is performed by use of the solution of ammonium monohydrogen difluoride in the first embodiment described above, there is a case where this etching liquid makes the crystalline grains conspicuous and exposes rolling scratches, depending on the etching conditions such as concentration, temperature and the like. These marks depend also on the material used and some of them look like a bamboo blind. Although these marks make little effect on the mirror surface characteristics of the panel, in the case where they are not preferable in terms of an outward appearance, etching the panel by use of a caustic soda, which is an alkali solution, for about ten seconds before etching the panel by the acid solution can improve the state of the mat surface such as rolling scratches.

Since the caustic soda does not etch grain boundaries so much collectively, roughening the front surface of the panel slightly in advance by use of the caustic soda produces the surface of the panel presenting a good outward appearance. In this connection, in the case where the front surface to be etched is provided with a film made of alodine or the like, if the front surface is treated as it is by use of the solution of ammonium monohydrogen difluoride, the front surface is made uneven, so etching the front surface by use of the caustic soda is very effective as a pretreatment of removing the alodine coating film.

The time of etching using the acid solution of ammonium monohydrogen difluoride and the time of etching as the pretreatment by use of an alkali solution using the caustic soda are determined by the requirement specifications of the surface roughness and the reflecting characteristics.

If the etching liquid, used here, containing ammonium monohydrogen difluoride is mixed with the alkali solution, etching performance deteriorates. Therefore, it is necessary to wash the panel with water after etching the panel by use of the alkali solution and to take care not to mix the acid etching liquid with the alkali solution used for the pretreatment.

Incidentally, the etching liquid used for the pretreatment is not limited to the caustic soda, but other alkali solution may be used.

As described above, according to the second embodiment, by etching the panel by use of the alkali solution using the caustic soda before etching the panel by use of the acid solution using ammonium monohydrogen difluoride, it is possible to produce an effect of enhancing the outward appearance of the front surface of the antenna panel 1.

(Third Embodiment)

While the mirror surface side of the panel before etching is finished to a very high accuracy (0.8 S) in the first embodiment as described above, it is possible to improve the sunlight reflecting characteristics by scattering the sunlight to a certain extent by means of the cutter marks produced when the mirror surface is machined.

In this connection, it is possible to control the surface roughness of the mirror surface with the cutter marks produced when the mirror surface is machined to an appropriate value by putting some thought into the shape of the tip of the cutter, for example, by using the cutter having irreguralities of about 2 $\mu$m RMS at the tip end. However, since the scattering angle in the direction parallel to the cutter marks are hardly improved, it is difficult to scatter the sunlight in all directions only by machining, and then other method such as etching or the like needs to be combined with the machining.

Further, taking into account that the cutter marks produced by machining can be utilized, it is considered that polishing by use of sandpaper, which can not produce good reflecting characteristics by itself, may be also utilized. However, when the mirror surface is polished with the sandpaper, the mirror surface is deformed by a large amount in the direction perpendicular to the direction of polishing scratches. Therefore, if the mirror surface can not be formed in the shape making allowance for the amount of deformation, it is difficult to adopt the polishing by use of the sand paper.

As described above, according to the third embodiment, it is possible to produce an effect of improving the sunlight reflecting characteristics by forming the fine bumps and dips 4 on the front surface side of the panel by a combination of the cutter marks, which are produced by machining, and etching.

As described above, according to the present invention, it is possible to produce an effect of constituting an antenna system that can be used for the radio waves in a high frequency range of from the millimeter waves to the sub-millimeter waves and that has an excellent reflecting performance and a high mirror surface accuracy capable of suppressing the collection of the sunlight by providing the antenna system with the antenna panel having fine bumps and dips formed on a mirror surface side, which is one of surfaces opposing to each other, by etching, wherein the fine bumps and dips scatter sunlight entering the mirror surface side of the antenna panel and regularly reflect the radio waves having longer wavelength than the sunlight entering the mirror surface side of the antenna panel.

According to the present invention, it is possible to produce an effect of constituting an antenna panel which is rich in the weatherproof characteristics by forming the fine bumps and dips having a chemical surface film formed thereon on the front surface of the antenna panel.

According to the present invention, it is possible to produce an effect of constituting an antenna system that can be used for the radio waves in a high frequency range of from the millimeter waves to the sub-millimeter waves and that has an excellent reflecting performance and a high mirror surface accuracy capable of suppressing the collection of the sunlight by providing the steps of: finishing front and back surface sides of opposing surfaces of each of the constituent parts; masking the back surface side of each of the finished constituent parts and etching the front surface side thereof to form the fine bumps and dips; and combining the plurality of constituent parts subjected to the etching step in such a manner that their front surface sides form the mirror surface side of the antenna panel to assemble the antenna panel of a desired shape.

According to the present invention, it is possible to produce an effect of enhancing the outward appearance of the front surface of an antenna panel by constituting an etching step by etching the front surface side of each of the finished constituent parts by use of an alkali solution and then by an acid solution.

According to the present invention, it is possible to produce an effect of constituting an antenna panel that is rich in the weatherproof characteristics by providing the step of applying a surface treatment for forming a chemical surface film to the front surface side of each of the constituent parts subjected to the etching step.

According to the present invention, it is possible to produce an effect of improving the sunlight reflecting performance of an antenna panel by forming fine bumps and dips on the front surface side of each of the constituent parts by cutter marks produced when the front surface side of each of the constituent parts is subjected to machining in the finishing step before the etching step.

What is claimed is:

1. An antenna system comprising:

an antenna panel having fine bumps and dips etched on a mirror surface side, but not on an opposing backside, wherein the fine bumps and dips scatter sunlight entering the mirror surface side of the antenna panel and regularly reflect radio waves having longer wavelengths than the sunlight entering the mirror surface side of the antenna panel, wherein a diameter of said antenna panel is at least approximately 10 m, and wherein a surface roughness of the fine bumps and dips is in a range of from 0.5 $\mu$m RMS to 5 $\mu$m RMS.

2. The antenna system as claimed in claim 1, wherein said fine bumps and dips are formed on the mirror surface side by etching the mirror surface side by use of an acid solution.

3. The antenna system as claimed in claim 1, wherein the mirror surface side of the antenna panel includes a chemical surface film formed on the fine bumps and dips.

4. The antenna system as claimed in claim 1, wherein the mirror surface side of the antenna panel includes a chemical surface film formed by alodine processing on the fine bumps and dips.

5. A method for manufacturing an antenna system in which an antenna panel is manufactured by combining a plurality of constituent parts, said method comprising the steps of:

finishing front and back surface sides of opposing surfaces of each of the constituent parts;

masking the back surface side of each of the finished constituent parts and etching the front surface side thereof to form the fine bumps and dips; and combining the plurality of constituent parts subjected to the etching step in such a manner that their front surface sides form the mirror surface side of the antenna panel to assemble the antenna panel of a desired shape.

6. The method for manufacturing an antenna system as claimed in claim 5, wherein the etching step is performed by etching the front surface side of each of the finished constituent parts by use of an acid solution.

7. The method for manufacturing an antenna system as claimed in claim 5, wherein the etching step is performed by etching the front surface side of each of the finished constituent parts by use of an alkali solution and thereafter by an acid solution.

8. The method for manufacturing an antenna system as claimed in claim 5, wherein the etching step is performed such that the surface roughness of the fine bumps and dips is made in a range of from 0.5 $\mu$m RMS to 5 $\mu$m RMS.

9. A method for manufacturing an antenna system as claimed in claim 5, further comprising the step of applying a surface treatment for forming a chemical surface film to the front surface side of each of the constituent parts subjected to the etching step.

10. The method for manufacturing an antenna system as claimed in claim 9, wherein the surface treatment step forms the chemical surface film by an alodine processing.

11. The method for manufacturing an antenna system as claimed in claim 5, wherein the finishing step forms the fine bumps and dips on the front surface side of each of the constituent parts by cutter marks produced when the front surface side of each of the constituent parts is subjected to machining.

* * * * *